United States Patent [19]

Scott

[11] Patent Number: 5,043,559

[45] Date of Patent: Aug. 27, 1991

[54] RADIANT ELECTRIC HEATERS

[75] Inventor: Richard C. Scott, Stourport-on-Severn, United Kingdom

[73] Assignee: Ceramaspeed Limited, Droitwich, England

[21] Appl. No.: 608,449

[22] Filed: Nov. 2, 1990

[30] Foreign Application Priority Data

Nov. 4, 1989 [GB] United Kingdom ..... 8924936

[51] Int. Cl.[5] ..... H05B 3/74

[52] U.S. Cl. ..... 219/464; 219/448

[58] Field of Search ..... 219/464, 466, 448, 449, 219/451, 452, 492, 494, 504, 505, 501

[56] References Cited

U.S. PATENT DOCUMENTS

| | | | |
|---|---|---|---|
| 2,681,973 | 6/1954 | Macoicz | 219/481 |
| 4,316,080 | 2/1982 | Wroblewski . | |
| 4,639,579 | 1/1987 | Brooks | 219/464 |
| 4,700,051 | 10/1987 | Goessler | 219/464 |
| 4,764,663 | 8/1988 | Scott | 219/448 |
| 4,789,772 | 12/1988 | McWilliams | 219/464 |
| 4,990,752 | 2/1991 | Worrall | 219/501 |

FOREIGN PATENT DOCUMENTS 2178914 2/1987 United Kingdom .

*Primary Examiner*—Teresa J. Walberg

*Attorney, Agent, or Firm*—Browdy and Neimark

[57] ABSTRACT

A radiant electric heater (10) has two coiled resistance wire heating elements (22,24) each connected to one terminal (N) of a power supply via respective rectifiers. These rectifiers are each made up of two like-poled arms of a bridge rectifier (34) connected in parallel, and they are arranged to allow current through one heating element (22) on positive-going half-cycles of the power supply waveform, and through the other heating element (24) on negative-going half-cycles. The elements are rated for continuous power dissipation under these circumstances. A PTC thermistor (36) is connected between the ends of the heating elements connected to the rectifiers. Optionally an NTC thermistor (40) can be connected in series with the PTC thermistor.

Upon initial energization the PTC thermistor is a near short-circuit, so current flows through both heating elements on both polarity half-cycles, dissipating twice their rated power. The elements increase in temperature more quickly than if they were initially energized at only their rated power, so the visible response of the elements to energization is faster. Meanwhile the PTC thermistor increases in resistance owing to self-heating, thereby removing the short-circuit after a few seconds, reducing the power dissipation in the elements to its normal level and protecting them from excessive operating temperatures.

5 Claims, 2 Drawing Sheets

RADIANT ELECTRIC HEATERS

FIELD OF THE INVENTION

This invention relates to radiant electric heaters.

BACKGROUND OF THE INVENTION

Radiant electric heaters are known in which an element of coiled bare electric resistance wire is supported on a layer of thermal insulation material compacted in a metal support dish. Such heaters are described, for example, in GB 1 580 909, and are incorporated in glass-ceramic smooth top cookers. Although these operate satisfactorily, a perceived disadvantage is that they take a relatively long time, of the order of 20 to 30 seconds, to respond visibly to changes in temperature control settings, in particular when they are first energized in the cold state. This delay can be reduced by using a thinner wire which thus runs at a higher temperature; however the overall operating life of such elements may be reduced and the response time is still of the order of 8 to 10 seconds.

Another kind of radiant electric heater, described in EP 0 117 346, incorporates infra-red lamp heating elements having tungsten filaments in a fused silica envelope containing a halogen atmosphere. Such heaters have an almost instantaneous response, of the order of 1 second or less. However, because of the pronounced positive temperature coefficient of resistance of tungsten their cold resistance is much less than their hot resistance. Consequently there is a high surge current when they are first energized, leading to problems in conforming with electricity utility regulations on disturbance to electricity supplies. Furthermore, such heating elements are substantially more costly than bare wire elements.

One solution that has been suggested to the problem of slow response of electric resistance wire heaters is to energize the wire heating element at a higher power than its normal operating power for a short period after it is first energized and until it has reached its normal operating temperature. However, this technique also has difficulties associated with it. Thus, in one implementation (GB 2 199 706), a complex and expensive electronic control circuit is required. In addition, it is necessary to ensure that if the heater is de-energized and then re-energized while it is still warm, the period of higher-power operation is shorter than if the element is completely cold. Otherwise the element will be operated at excessive power while hot and will overheat, thereby reducing its operating life. This is particularly important in the case of heaters controlled by cyclic energy regulators, in which the energization of the heater is repeatedly interrupted to provide an adjustable average level of energization.

It is an object of this invention to provide a radiant electric heater with a relatively fast response, of the order of about 5 seconds or less, which alleviates some of these problems.

SUMMARY OF THE INVENTION

According to one aspect of this invention there is provided a radiant electric heater comprising first and second resistive heating elements arranged to be coupled to one terminal of an electric supply via respective, oppositely-poled rectifiers, and a positive temperature coefficient thermistor coupled between the ends of the heating elements connected to the respective rectifiers.

Preferably the elements have approximately equal resistances, in order to minimize any d.c. component in the current drawn from the power supply.

A negative temperature coefficient thermistor may be connected in series with said positive temperature coefficient thermistor, in order to limit any initial current surge when the heater is energized.

The rectifiers can conveniently each comprise two like-poled arms of a bridge rectifier connected in parallel. This simplifies mounting, connection and insulation, and may limit cost.

The rectifiers and thermistor may be mounted in the vicinity of a control device for regulating the power dissipated by the heater, such as a cyclic energy regulator. This simplifies their mounting and wiring, avoids exposing the rectifiers and thermistor to temperatures above their operating limits and also provides an appropriate thermal environment for correct operation of the thermistor.

BRIEF DESCRIPTION OF THE DRAWINGS

Radiant electric heaters in accordance with this invention for use in a glass ceramic top cooker will now be described, by way of example, with reference to the accompanying drawings, in which.

DESCRIPTION OF THE PREFERRED EMBODIMENTS

Figure 1:
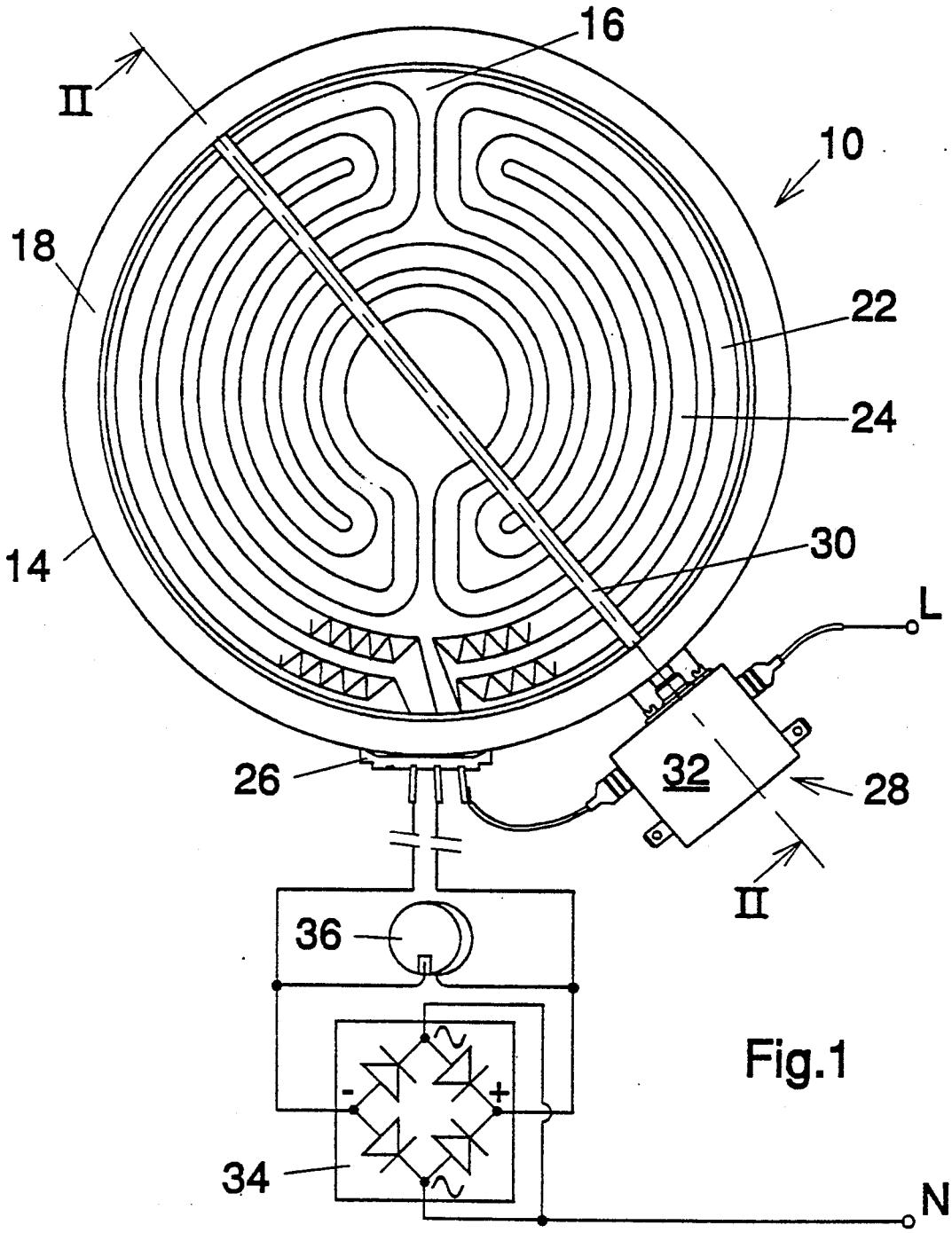
FIG. 1 is a partially schematic view of a first form of heater, showing a heater dish and heating elements in plan.
Figure 2:
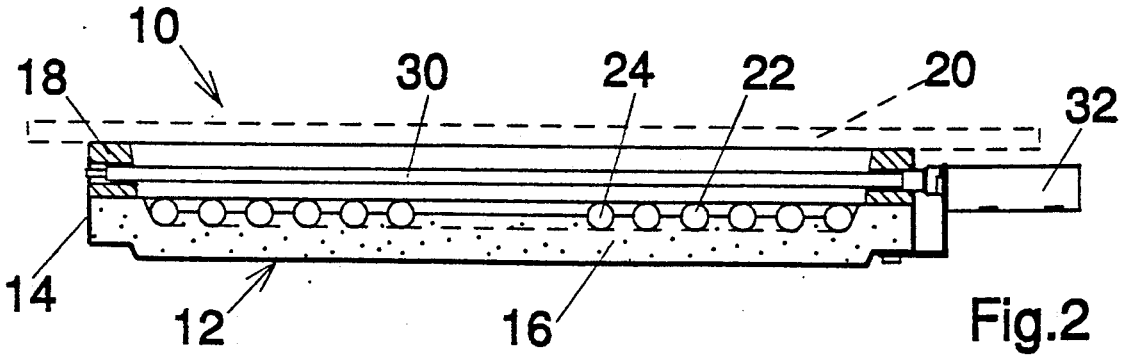
FIG. 2 is a sectional view along the line II—II of the dish and heating elements of FIG. 1.

Referring to FIGS. 1 and 2, a radiant electric heater 10 has a container in the form of a metal dish 12 with an upstanding rim 14 and containing a layer of electrical and thermal insulating material 16. This material is for example a microporous insulation which comprises a highly-dispersed silica powder, such as silica aerogel or pyrolytic (fumed) silica, mixed with ceramic fibre reinforcement, titanium dioxide opacifier and a small quantity of alumina powder to resist shrinkage, and which is compressed into the dish 12. A ring-shaped wall 18 of ceramic fibre extends around the inside of the rim 14 of the dish 12, on top of the layer 16 and protruding slightly above the edge of the rim 14. When installed in a glass ceramic top cooker the wall 18 is pressed against the underside of a glass ceramic cooking surface, shown in dashed outline at 20 in FIG. 2, the heater 10 being held in position by a spring or other mounting device (not shown). Prior to installation the wall 18 is retained in position by staples extending into the layer 16.

The layer 16 supports two coiled bare resistance wire heating elements 22 and 24 which are laid out in interpenetrating serpentine configurations of generally concentric circles. Such an arrangement provides an aesthetically pleasing appearance, with each element seeming to extend over most of the heated area, whilst at the same time accommodating the required lengths of wire and promoting uniform heat distribution. The coiled elements 22 and 24 are secured to the layer 16 by, for example, staples held by friction in the insulating material of the layer 16, or by gluing to the layer 16 or to stakes inserted therein. The ends of the wire heating elements 22 and 24 are coupled to an electrical connector block 26 mounted at the edge of the dish 12, one end of each element being coupled to a common connector and the other ends being coupled to individual connectors.

Figure 3:
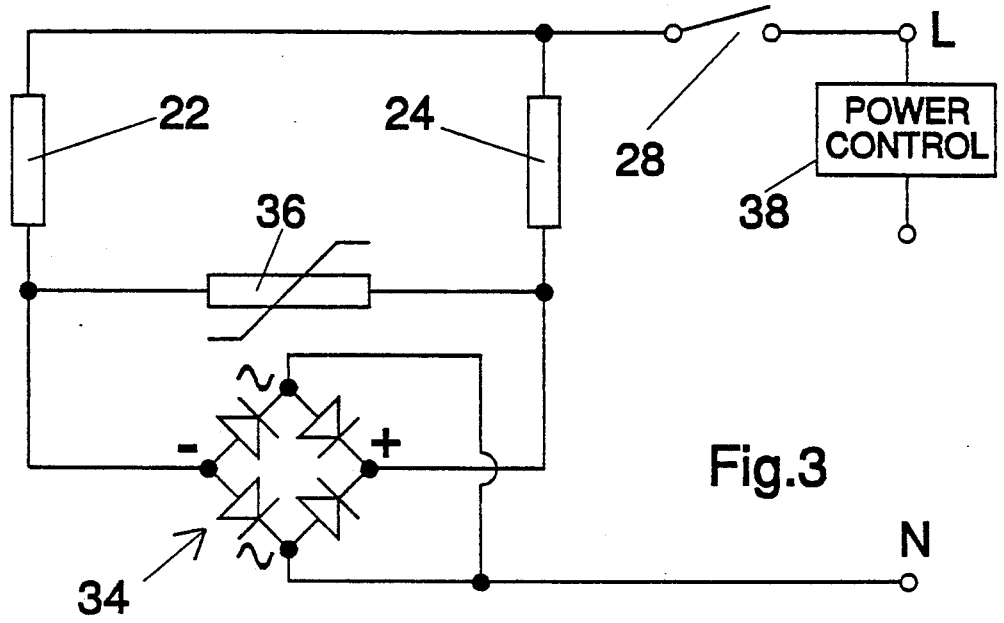
FIG. 3 is a schematic circuit diagram of the heater of FIGS. 1 and 2.

As is customary with heaters for glass ceramic top cookers, a temperature sensitive rod limiter 28 is provided with its probe 30 extending across the heater 10 above the elements 22 and 24. This probe typically comprises a fused silica tube containing a metal rod. A snap-action switch 32 controlled by the probe 30 is connected in series with the elements 22 and 24 at their common connection, as is also shown in FIG. 3, and is itself coupled at terminal L to the live line of a power supply.

The remaining ends of the elements 22 and 24 are coupled via the connector 26 to the negative and positive terminals respectively of a bridge rectifier 34 (though this polarity may be reversed). This rectifier is rated in accordance with the supply voltage and power rating of the heating elements 22 and 24; for example at 600 V, 17 A, assuming the elements 22 and 24 are rated for a continuous power dissipation of 850 W each on a 240 V supply. The a.c. terminals of the rectifier 34 are connected together, and via terminal N to the neutral line of the power supply.

Figure 4:
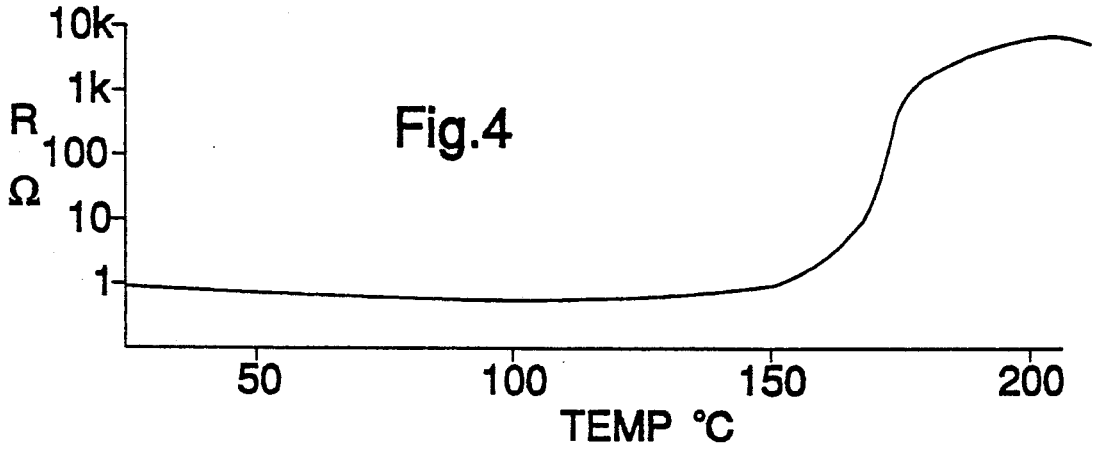
FIG. 4 shows the variation of resistance with temperature of a PTC thermistor forming part of the heater of FIG. 1.

A positive temperature coefficient (PTC) thermistor 36, rated at 265 V, 20 A maximum, is connected between the ends of the heating elements 22 and 24 which are coupled to the bridge rectifier 34. This thermistor, which is typically made of barium titanate, has a resistance/temperature characteristic as shown in FIG. 4. Suitable thermistors are available for example from Siemens of West Germany.

The power supply via the terminals L and N is controlled by the user with a conventional control device 38, such as a cyclic energy regulator or multi-position switch (shown schematically in FIG. 3). such devices are normally mounted in a control box adjacent the glass ceramic cooking surface, and the rectifier 34 and thermistor 36 can conveniently be located in the same box. In this way the maximum temperature specification of the rectifier and thermistor can be respected, and the thermistor is kept in an environment which permits it to heat up and cool down as necessary.

When the heater 10 is energized in the cold condition, the thermistor 36 is in its low resistance state and thus virtually short-circuits together the ends of the elements 22 and 24 coupled to the bridge rectifier 34. Consequently electric current from the a.c. supply can flow through both elements during half-cycles of either polarity. The heating elements are rated so that they are temporarily over-driven in this state, resulting in a rapid temperature rise in response to the commencement of energization. Consequently the element becomes visibly incandescent more quickly than if it were energized at its rated power level.

However, the current flowing through the thermistor causes it to be self-heated, resulting in an increase in its resistance, effectively removing the short-circuit between the heating elements 22 and 24 after a few seconds (typically 4 to 5 seconds). This leaves these elements connected in series with a respective half of the bridge rectifier 34. As a result, each heatinq element now passes current on only the positive-going or negative-going half-cycles respectively, thereby halving the power dissipated in it. The elements are designed to dissipate their continuous rated power in this mode. Because current is still drawn from the supply on each half-cycle, there is little or no direct current component in this current; the resistances of the two elements 22 and 24 are preferably matched as closely as possible to minimize any such d.c. component.

When the heater 10 is de-energized, the thermistor 36 will retain heat for a short period of time. Thus, if the heater 10 is re-energized while the heating elements 22 and 24 are still warm (so the time to reach incandescent temperature is shorter), the thermistor 36 will reach its high temperature state more quickly, thereby protecting the elements 22 and 24 against operation at excessively high temperatures.

The matching between the time taken for the heating elements 22 and 24 to reach incandescence and the change in state of the thermistor 36 from low resistance to high resistance can be adjusted if necessary by adding thermistors in parallel with the thermistor 36. However, for large-scale production it is envisaged that a thermistor having appropriate characteristics for use with a specific heater would be procured.

Figure 5:
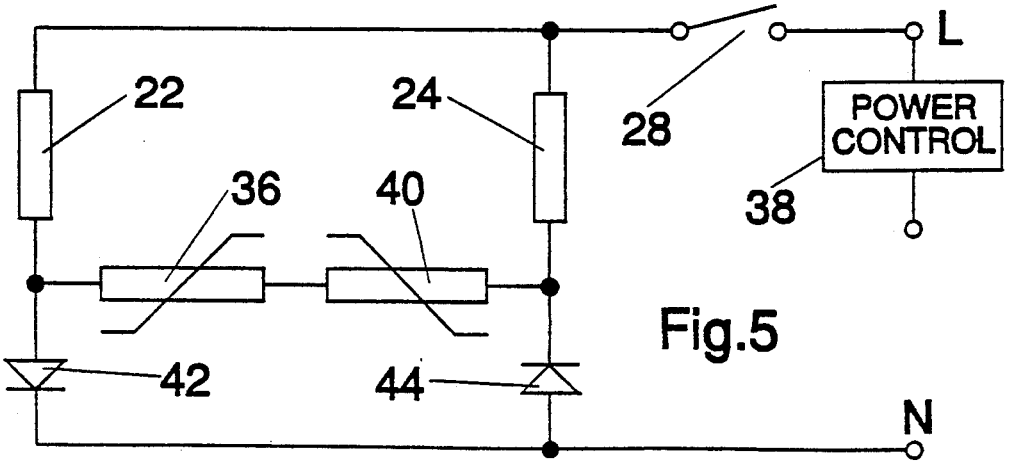
FIG. 5 is a schematic circuit diagram of a modified heater.

FIG. 5 shows two modifications to the circuit of FIG. 3, which may be used separately or together. A negative temperature coefficient (NTC) thermistor 40 is connected in series with the PTC thermistor 36 between the heating elements 22 and 24. This NTC thermistor has characteristics chosen so that it heats up, and thus drops to a very low resistance, in a period of the order of a second. This has the advantage of reducing any initial current surge that may otherwise occur when the elements 22 and 24 are completely cold. Consequently improved conformance with power supply disturbance regulations can be provided.

As also shown in FIG. 5, the bridge rectifier 34 may be replaced by two individual diode rectifiers 42 and 44, one each in series with a respective heating element 22 and 24 and arranged with opposite poles connected towards the live terminal L, so as to pass a.c. half-cycles of opposite polarity. It can be seen that the bridge rectifier 34 in FIG. 3 is connected so that it has two like-poled arms connected in parallel on each side, thereby producing the same electrical circuit action as the individual rectifiers 42 and 44 in FIG. 5. The bridge rectifier 34 has the advantage that its use can simplify mounting, insulation and connection of the thermistor and the rectifying components in the circuit.

I claim:

1. A radiant electric heater comprising first and second resistive heating elements arranged to be coupled to one terminal of an electric supply via respective, oppositely-poled rectifiers, and a positive temperature coefficient thermistor coupled between the ends of the heating elements connected to the respective rectifiers.

2. The heater of claim 1, wherein the elements have approximately equal resistances.

3. The heater of claim 1, wherein a negative temperature coefficient thermistor is in series with said positive temperature coefficient thermistor.

4. The heater of claim 1, wherein the rectifiers each comprise two like-poled arms of a bridge rectifier connected in parallel.

5. The heater of claim 1 in combination with means for controlling the power dissipated by the heater, wherein said rectifiers and thermistor are mounted in proximity to the control means.

* * * * *